US009250046B2

(12) United States Patent
Birkin et al.

(10) Patent No.: US 9,250,046 B2
(45) Date of Patent: Feb. 2, 2016

(54) DETONATOR

(71) Applicant: DETNET SOUTH AFRICA (PTY) LTD, Sandton (ZA)

(72) Inventors: Christopher Malcolm Birkin, Sandton (ZA); Johannes Petrus Kruger, Sandton (ZA); Herman Van Der Walt, Sandton (ZA)

(73) Assignee: DETNET SOUTH AFRICA (PTY) LTD, Sandton (ZA)

( * ) Notice: Subject to any disclaimer, the term of this patent is extended or adjusted under 35 U.S.C. 154(b) by 0 days.

(21) Appl. No.: 14/365,618

(22) PCT Filed: Nov. 20, 2012

(86) PCT No.: PCT/ZA2012/000088
§ 371 (c)(1),
(2) Date: Jun. 13, 2014

(87) PCT Pub. No.: WO2013/090948
PCT Pub. Date: Jun. 20, 2013

(65) Prior Publication Data

US 2014/0326154 A1 Nov. 6, 2014

(30) Foreign Application Priority Data

Dec. 14, 2011 (ZA) ..... 2011/09193
Jan. 24, 2012 (ZA) ..... 2012/00553

(51) Int. Cl.
*F42B 3/12* (2006.01)
*F42B 3/195* (2006.01)
*F42B 3/103* (2006.01)

(52) U.S. Cl.
CPC ..... *F42B 3/121* (2013.01); *F42B 3/103* (2013.01); *F42B 3/12* (2013.01); *F42B 3/125* (2013.01); *F42B 3/195* (2013.01)

(58) Field of Classification Search
CPC ..... F42B 3/10; F42B 3/12; F42B 3/13; F42B 3/103; F42B 3/107; F42B 3/121; F42B 3/125; F42B 3/195
USPC ..... 102/202.5, 202.7, 202.9, 202.11, 102/202.12, 202.14
See application file for complete search history.

(56) References Cited

U.S. PATENT DOCUMENTS 5,686,691 A * 11/1997 Hamilton et al. ..... 102/202.5
5,889,228 A * 3/1999 Ewick et al. ..... 102/275.5
6,408,759 B1 * 6/2002 Ewick et al. ..... 102/202.5

(Continued)

FOREIGN PATENT DOCUMENTS

EP 0780659 A2 6/1997
EP 1548391 A1 6/2005
WO 9845663 A1 10/1998

OTHER PUBLICATIONS

International Search Report for PCT/ZA2012/000088 dated May 23, 2013 (3 pages).

(Continued)

*Primary Examiner* — James S Bergin
(74) *Attorney, Agent, or Firm* — Michael Best & Friedrich LLP

(57) ABSTRACT

A detonator which includes a tubular body within which is located a detonator assembly which comprise a container (20) which houses a set explosive composition element in which is embedded part of a PCB (72, 76) which carries an ignition element (66).

18 Claims, 10 Drawing Sheets

(56) References Cited

U.S. PATENT DOCUMENTS

| | | | | |
|---|---|---|---|---|
| 6,644,197 | B2 | 11/2003 | Goernig et al. | |
| 6,739,264 | B1 * | 5/2004 | Hosey et al. | 102/202.9 |
| 9,004,933 | B2 * | 4/2015 | Birkin | 439/310 |
| 2004/0083919 | A1 | 5/2004 | Hosey | |
| 2005/0066832 | A1 * | 3/2005 | Mausy | 102/202.2 |

OTHER PUBLICATIONS

International Preliminary Report on Patentability for PCT/ZA2012/000088 dated Apr. 22, 2014 (6 pages).
Written Opinion for PCT/ZA2012/000088 (5 pages).

* cited by examiner

DETONATOR

BACKGROUND OF THE INVENTION

This invention relates to an electronic detonator and to a method of manufacturing an electronic detonator.

Typically an electronic detonator includes a tubular housing which contains a printed circuit board which carries various electronic components. An ignition element such as a bridge is provided on the board. The ignition element is exposed to a primary explosive composition which is exposed to a secondary explosive material.

To achieve reliable operation of the detonator it is inter alia necessary to ensure that the primary explosive composition is in intimate contact with the ignition element. A technique which has been adopted requires a portion of the printed circuit board, which carries the ignition element, to be located inside a bore of a tube which has opposed open ends. The printed circuit board protrudes from one end of the enclosure (the tube) and, as an initial step, this end is sealed through the use of a suitable potting mixture which also adheres to an adjacent portion of the printed circuit board. The printed circuit board and the tube are then orientated so that the remaining open end of the tube is uppermost. A suitable primary explosive, which is in particulate form, is then placed into the tube through the open upper end and is tamped in position thereby to bring the composition into contact with the ignition element. This process does, however, have some disadvantages.

Firstly, the sealing of the printed circuit board to the tube can be problematic. If the sealing is not properly done a malfunction can occur. The potting compound can also damage the electronic components on the printed circuit board.

A second aspect is that the quantity of explosive composition which is placed in particulate form into the tube may vary from detonator to detonator—a feature which can produce inconsistent outcomes. Also, the tamping of the composition around the ignition element can result in physical damage to the element.

EP1548391 describes a detonator assembly in which a printed circuit board, carrying an ignition element, is positioned partly inside a cup-shaped body. The ignition element is covered by a settable explosive composition. There is however no disclosure of any mechanism which enables the printed circuit board to be precisely and correctly positioned relative to the cup-shaped body.

An object of the present invention is to address the aforementioned aspects.

SUMMARY OF INVENTION

The invention provides a detonator assembly comprising a container which comprises a cup-shaped moulded body with a base, a mouth and a wall with an inner surface and an outer surface, a printed circuit board with a mounting location, an ignition element which is mounted to the board at the mounting location, wherein the ignition element and at least said mounting location extend through the mouth into an interior of the cup-shaped body, the printed circuit board and the cup-shaped body including complementary formations which are interengageable thereby to retain the printed circuit board engaged with the cup-shaped body when the printed circuit board is in a desired position relative to the cup-shaped body, and an explosive composition which, in fluent form, in the interior of the cup-shaped body covers at least the ignition element and the mounting location, and which is then allowed to set, in situ, to form a solid component in which the ignition element and the mounting location are embedded.

Formations may be provided on the inner surface of the body which act as keying formations and which help to bond the composition, when it sets, to the body.

The container may have at least one guide formation, which may be on the inner surface, which assists in positioning the printed circuit board, and thus the ignition element, correctly within the body. The guide formation may include a slot, a channel or the like which extends in a longitudinal direction of the cup-shaped body.

The printed circuit board and the cup-shaped body may include complementary formations which are interengageable thereby to retain the printed circuit board engaged with the cup-shaped body when the printed circuit board is in a desired position relative to the cup-shaped body.

The explosive composition may be of any appropriate type and for example may include at least one of the following: lead azide, lead styphnate, DDNP, DC20, calcium nitriminotetrazole and B/$KNO_3$/DLA. The explosive material may be provided together with a binder such as nitro cellulose, gum arabic or Alcolex 290-EVA. An important aspect is that the binder should have the capability of keeping the explosive material in suspension with limited segregation over time. This allows volumetric dosing of the explosive composition to be carried out. The binder may be carried in a solvent which may be volatilised at a relatively low temperature e.g. of the order of 60° C. to 80° C.

The aforementioned examples of explosive, binder and solvent are exemplary only and are non-limiting.

The detonator may include an elongate tubular housing within which the detonator assembly is located.

The cup-shaped body may include one or more formations which exert a wiping action on an inner surface of the tubular housing when the detonator assembly is engaged with the tubular housing.

At least one formation may be provided on the outer surface of the cup-shaped body to ensure that the detonator assembly is correctly positioned inside the tubular housing and that, to a substantial extent, relative movement between the detonator assembly and the tubular housing is eliminated.

The detonator may include at least one support which is engaged with the printed circuit board and which positions the printed circuit board correctly inside the tubular housing.

In one form of the invention the container includes at least one formation which is engageable with the printed circuit board thereby to position the ignition element at a desired location within the cup-shaped body. The at least one formation may be of any suitable shape or size. Preferably there are two formations which oppose each other and which project away from the cup-shaped body. Each formation may act as a guide e.g. be in the form of a slot in which an edge of the printed circuit board is located with a sliding action.

The container and the printed circuit board may have respective stop formations which are interengageable when the ignition element is at said desired location e.g. each slot may have a projection and the printed circuit board may have a corresponding recess.

The printed circuit board and the cup-shaped body may be dimensioned or shaped so that a portion of the printed circuit board, which is moved into the cup-shaped body, does not contact the inner surface—the attainment of this feature is assisted by means of the guiding action exerted by the slot or slots on the printed circuit board i.e. that portion of the printed circuit board which is inside the cup-shaped body contacts the slot or slots only, and does not contact any other part of the inner surface.

In another variation a seal is engaged with the printed circuit board and which is movable to engage with the mouth of the cup-shaped body when the ignition element is correctly positioned within the body. The seal thus acts to ensure that the ignition element is correctly positioned, and does this in a way which helps to prevent the printed circuit board from contacting the inner surface of the cup-shaped body. This is important for frictional effects between opposing and contacting parts of the printed circuit board and the inner surface of the cup-shaped body could conceivably cause firing of the fluent explosive composition.

BRIEF DESCRIPTION OF THE DRAWINGS

The invention is further described by way of examples with reference to the accompanying drawings in which.

DESCRIPTION OF PREFERRED EMBODIMENTS

Figure 1:
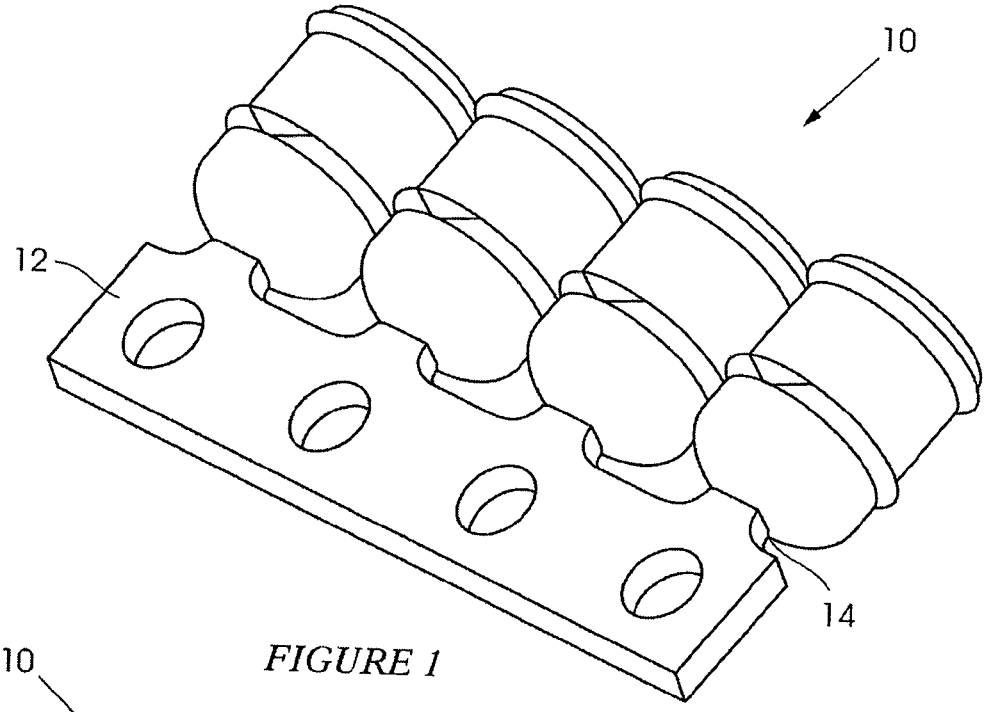
FIG. 1 is a perspective view showing, at a final stage of manufacture, a number of interconnected containers each of which is used in a respective detonator assembly according to the invention.

FIG. 1 of the accompanying drawings illustrates in perspective a number of containers 10 which are made in an injection moulding process. The containers are identical to one another. For ease of handling the containers are linked together by means of a disposable member 12. Each container is coupled to the member at a respective break line 14.

Figure 2:
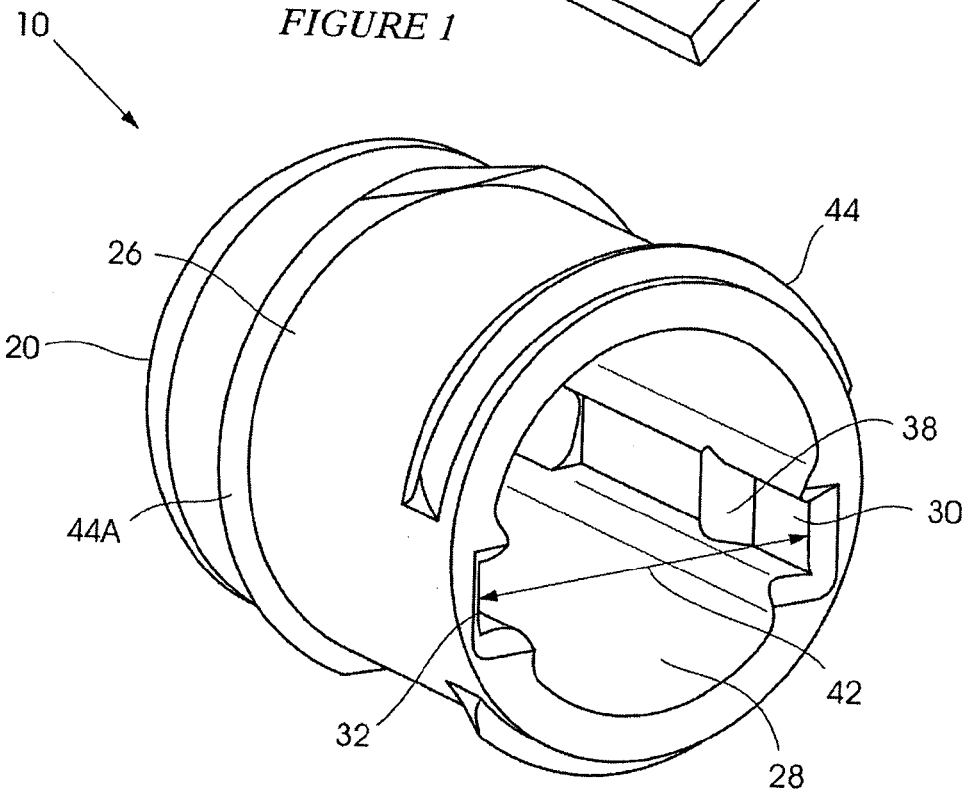
FIG. 2 is an enlarged view in perspective of one of the containers shown in FIG. 1.
Figure 3:
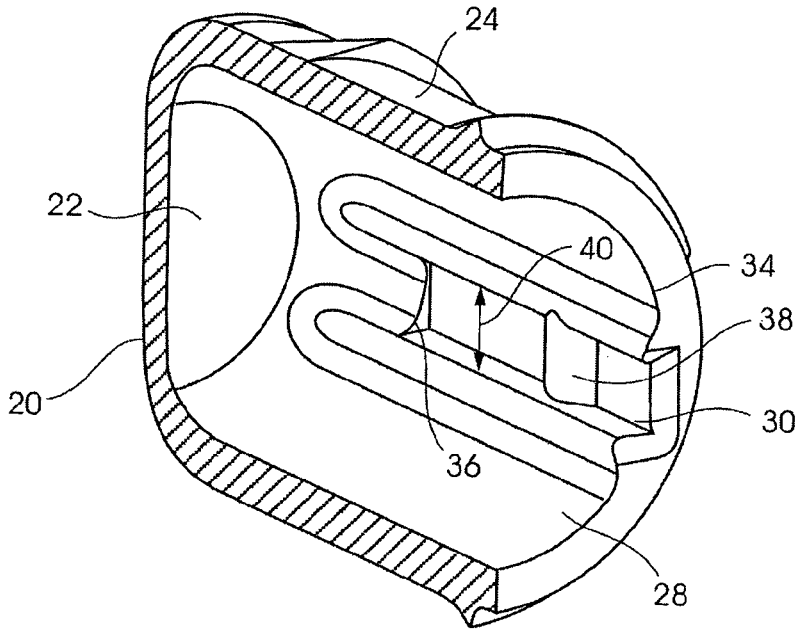
FIG. 3 is a sectioned perspective view of the container in FIG. 2.

FIGS. 2 and 3 are perspective views of a container 10, from one side, and in section from one side, respectively, on an enlarged scale relative to the scale shown in FIG. 1.

The container 10 has a cup-shaped body 20 with a base 22 and a wall 24. The wall has an outer surface 26 and an inner surface 28.

The inner surface 28, at diametrically opposed locations, has guiding and locating slots 30 and 32 respectively which extend axially from a mouth 34 of the body towards the base 22. Each slot terminates in a respective stop formation 36. At an intermediate location each slot has a respective rounded projection 38. Each slot has a width 40. The slots are diametrically spaced apart by a distance 42.

The outer surface 26 of the body 20 has two spaced ring formations 44 and 44A respectively.

The length of the body 20 in its axial direction can be varied according to requirement.

Figure 4:
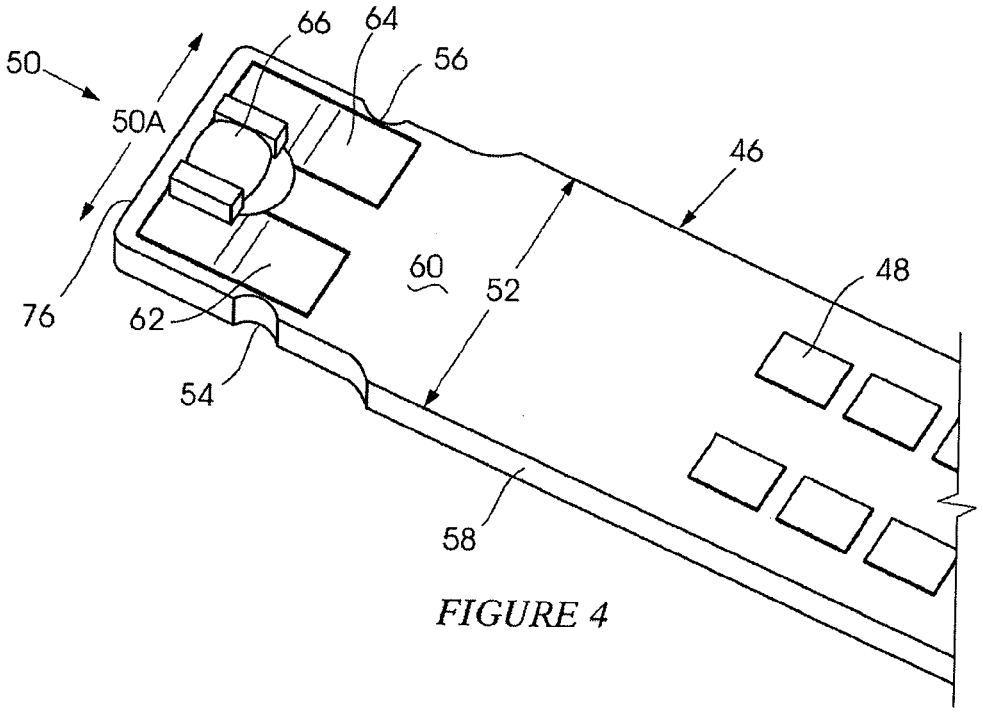
FIG. 4 is a perspective view of part of a printed circuit board which carries an ignition element, for use in a detonator according to the invention.

FIG. 4 shows a part of a printed circuit board 46 which generally is of conventional construction and which, for this reason, is not described in detail. The printed circuit board has a substantially elongate rectangular outline and carries circuits and electronic components 48, as is known in the art. An end 50 (referred to herein as a leading end) of the printed circuit board has a reduced dimension 50A compared to the width 52 of the remainder of the board. Opposed recesses 54 and 56 are formed in respective sides 58 of the board at the reduced width leading end. On a surface 60 the board has contact pads 62 and 64. An ignition element 66 of any appropriate kind is positioned between the contact pads. The ignition element may be a bridge component, a so-called integrated circuit "hot spot", or any equivalent mechanism which is designed to dissipate a quantity of electrical energy thereby to ignite a primary explosive composition exposed to the ignition element.

Figure 5:
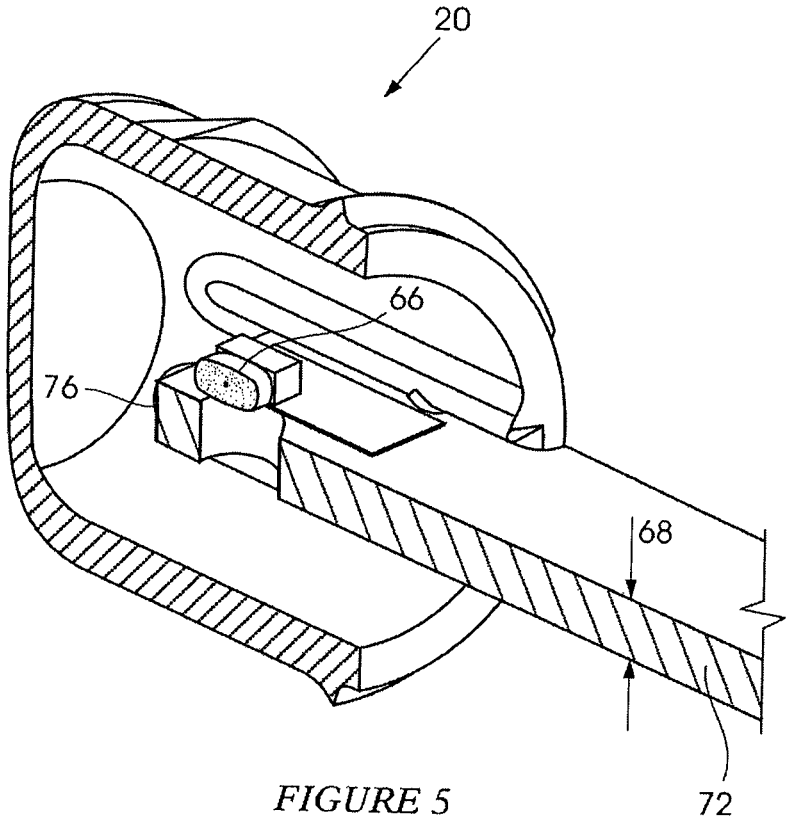
FIG. 5 is a sectioned view, in perspective, illustrating the printed circuit board of FIG. 4 engaged with the container of FIG. 3.

The leading end 50 of the printed circuit board is designed to be engaged with a sliding action, as is shown in the sectioned perspective view of FIG. 5, with the cup-shaped body 20. The width 40 of each slot is slightly greater than the thickness 68 of the printed circuit board. Additionally the spacing 42 is slightly greater than the width 50A of the leading end. Thus the leading end can be inserted with a guiding and sliding action directly into the cup-shaped body. This movement can take place until an edge 76 of the leading end 50 of the printed circuit board strikes the stop formations 36 on opposed sides of the inner surface 28. At this point the recesses 54 and 56 are slipped into engagement with the respective projections 38 in the two guide slots 30 and 32. The printed circuit board is thereby physically engaged with the container 10 in a manner which ensures that the ignition element 66 is firmly located at a desired and defined position inside the cup-shaped body.

Figure 6:
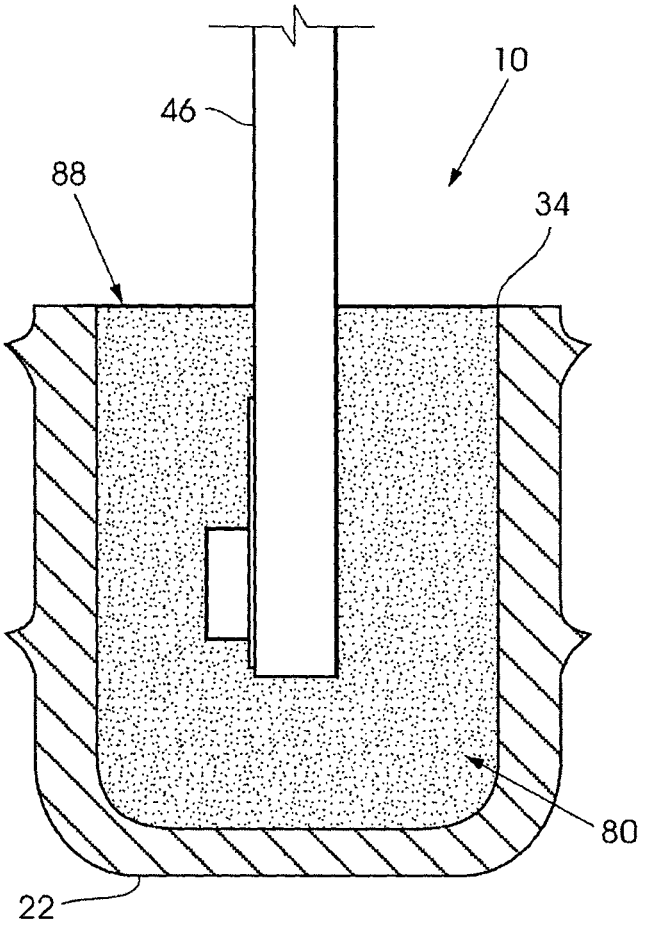
FIG. 6 depicts somewhat schematically a manufacturing step which is carried out after the engagement process shown in FIG. 5.

FIG. 6 depicts a subsequent step in the manufacturing process. The container 10 and the printed circuit board 46 are orientated so that the base 22 is lowermost and horizontal and so that the printed circuit board extends vertically upwardly from the container. A fluent explosive composition 80 which has been separately prepared is then placed into an interior of the cup-shaped body. The composition is made in any appropriate manner so that it can be accurately dispensed, on a volumetric basis, e.g. by processing or by means of an injection system, and so that, thereafter, it is capable of setting.

The explosive material inside the composition may be selected from lead azide, lead styphnate, DDNP, DC20, calcium nitriminotetrazole and B/$KNO_3$/DLA. A binder e.g. of nitro cellulose, gum arabic or Alcolex 290-EVA is used with an appropriate solvent to keep the explosive material in suspension with limited segregation over time. This allows the placing of the fluent composition into the cup-shaped body to be effected, if required, by means of an accurately controlled mechanised or by a partly or fully automated volumetric dosing process.

The aforementioned explosives and binders are mentioned by way of example only and are non-limiting. The solvent which is used with the binder should be capable of volatilising at a relatively low temperature e.g. of the order of 60° C. to 80° C. so that setting of the fluent composition is readily carried out.

The fluent composition 80 fills the interior of the body up to the mouth 34. The composition is then cured or dried by placing the detonator assembly in an appropriate chamber or oven under controlled conditions. The composition sets into a solid component 86, see FIG. 7, inside the cup-shaped body. The ignition element and an adjacent portion of the printed circuit board are firmly embedded in the solid component and the explosive composition is thereby kept in intimate contact with the ignition element.

The component 86 and the cup-shaped body to which it is bonded make up a detonator assembly 88 which can easily be handled.

In an alternative, preferred, approach the composition 80 is placed into the cup-shaped body first and, thereafter, the printed circuit board is engaged with the body, generally in the manner described, but with the leading end 50 gradually being immersed in the fluent composition in the tubular component.

Figure 7:
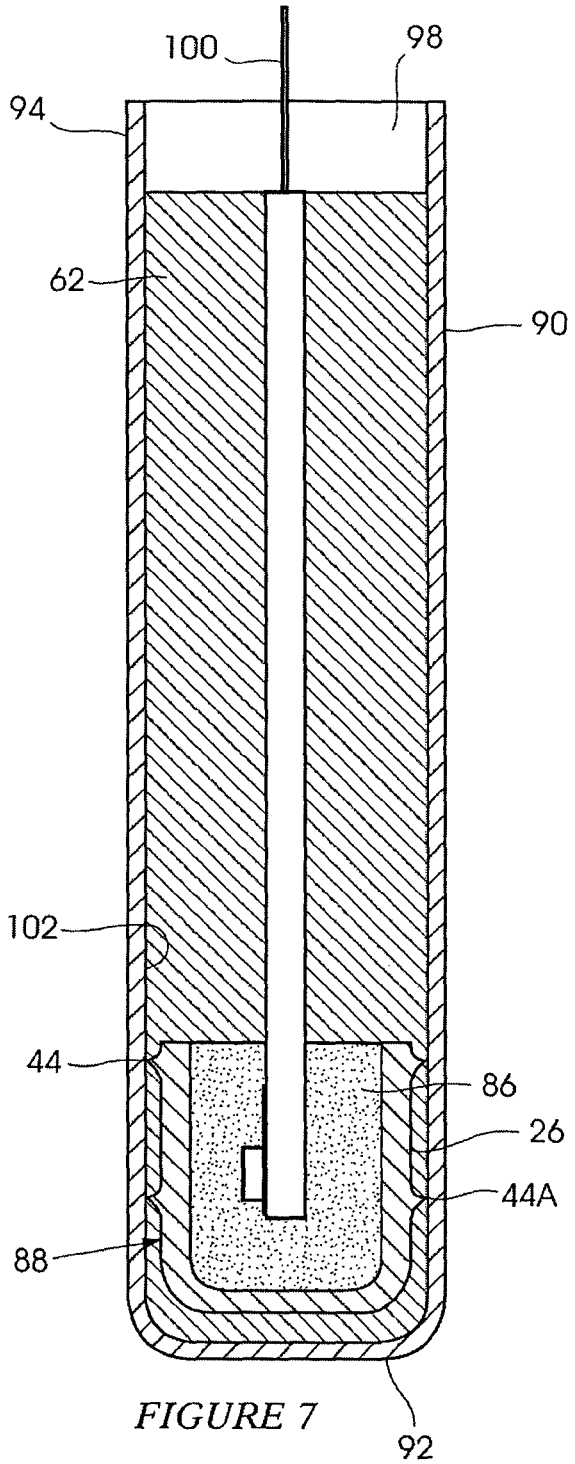
FIG. 7 is a sectioned side view of a detonator made in accordance with the principles of the invention.

In a subsequent manufacturing step the detonator assembly 88, comprising the printed circuit board, the container and the explosive composition, is positioned inside an elongate tubular housing 90 which may be metallic or of any other suitable material, and which has a blind end 92 and an open end 94, as shown in FIG. 7. A secondary explosive material 96 fills an interior of the tubular housing. The end 94 is sealed by means of a suitable plug 98 and by a crimping operation. A harness connection 100 to the components on the printed circuit board, extends through the seal.

The rings 44 and 44A on the outer surface 26 of the body are dimensioned so that they engage with a close fitting, wiping action with, and thereby clean, an inner surface 102 of the tubular housing when the detonator assembly is slid into the housing. Additionally, the rings firmly position the detonator assembly inside the housing.

Figure 8:
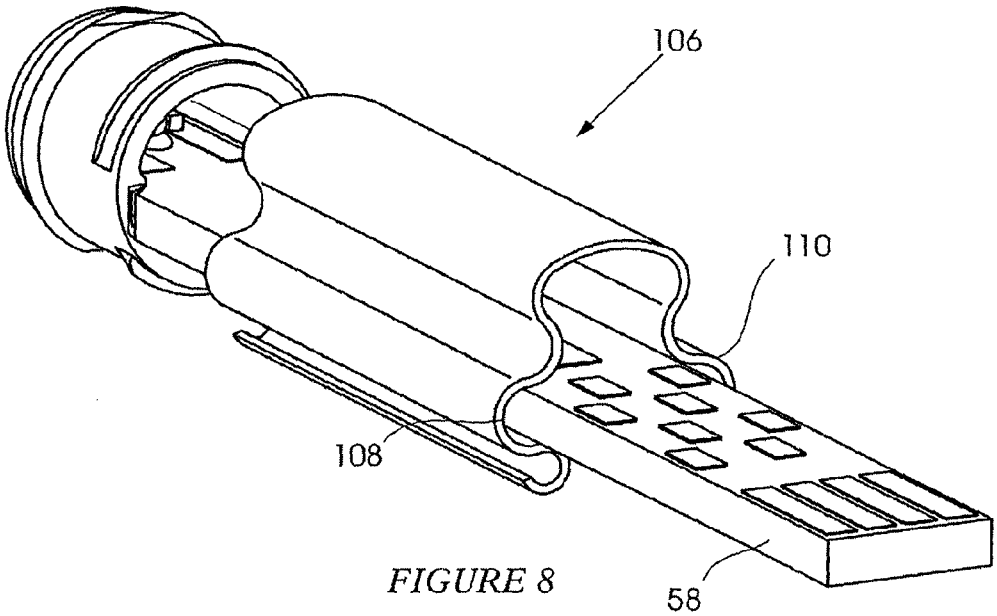
FIG. 8 is a perspective view of a detonator assembly according to a variation of the invention.
Figure 9:
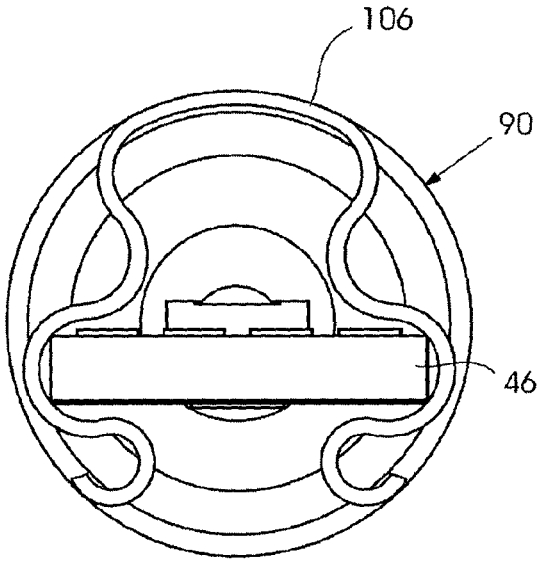
FIG. 9 is an end view of the detonator assembly shown in FIG. 8.

Different techniques can be adopted, if necessary, to ensure that the printed circuit board is correctly positioned over its length inside the tubular housing. One appropriate arrangement is shown in FIGS. 8 and 9. A shaped, slightly flexible component 106, e.g. of a suitable plastics material, is designed so that it has opposing elongate recesses or channels 108 and 110 which are frictionally engageable with opposed sides 58 of the printed circuit board. The component 106, see FIG. 9, has a serpentine shape in cross-section to ensure that the use of the component does not impede the manufacturing process of the detonator. This shape allows the secondary explosive material 96 to be inserted with ease into the interior of the tubular housing 90 and fill it completely. The component 106 has a maximum outer dimension which is configured to ensure that the component will not overlap with any part of the cup-shaped body 20, when viewed in an axial direction. This ensures that the component will closely engage with an inner surface of the tubular housing and that the printed circuit board will then be correctly positioned inside the housing.

The manufacturing process of the invention holds a number of benefits. Firstly, the potting or sealing problems which are encountered in prior art techniques are avoided. The printed circuit boards and the cup-shaped bodies can be shipped from separate locations to a factory for assembly. Special tooling is not required at the manufacturing location of the printed circuit board. The possibility that electronic components on the printed circuit board can be damaged during a potting or sealing step is eliminated. The use of the fluent explosive composition ensures that an intimate bond is formed between all the components without additional processes being called for. The fluent composition is volumetrically dispensable into the cup-shaped body. This reduces the likelihood of air voids being formed inside the explosive composition. Physical damage to the ignition element, due to a tamping or pressing operation is avoided.

The printed circuit board and the container clip together mechanically which means that the strength of the bond between the printed circuit board and the container is not dependent only on the binding effect of the explosive composition when it sets.

In the arrangement depicted in FIGS. 1 to 5 the slots 30 and 32 are on the inner surface 28. This means that when the printed circuit board is pushed into the cup-shaped body, which contains a fluent explosive composition, frictional effects between opposing, contacting and relatively moving surfaces of the printed circuit board and of each slot can, conceivably, cause ignition of the explosive.

Figure 10:
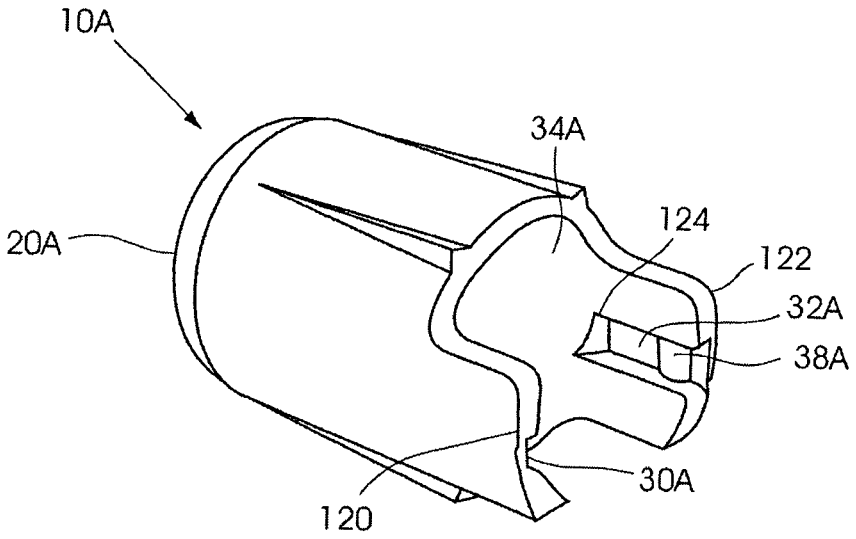
FIG. 10 shows a modified container.
Figure 11:
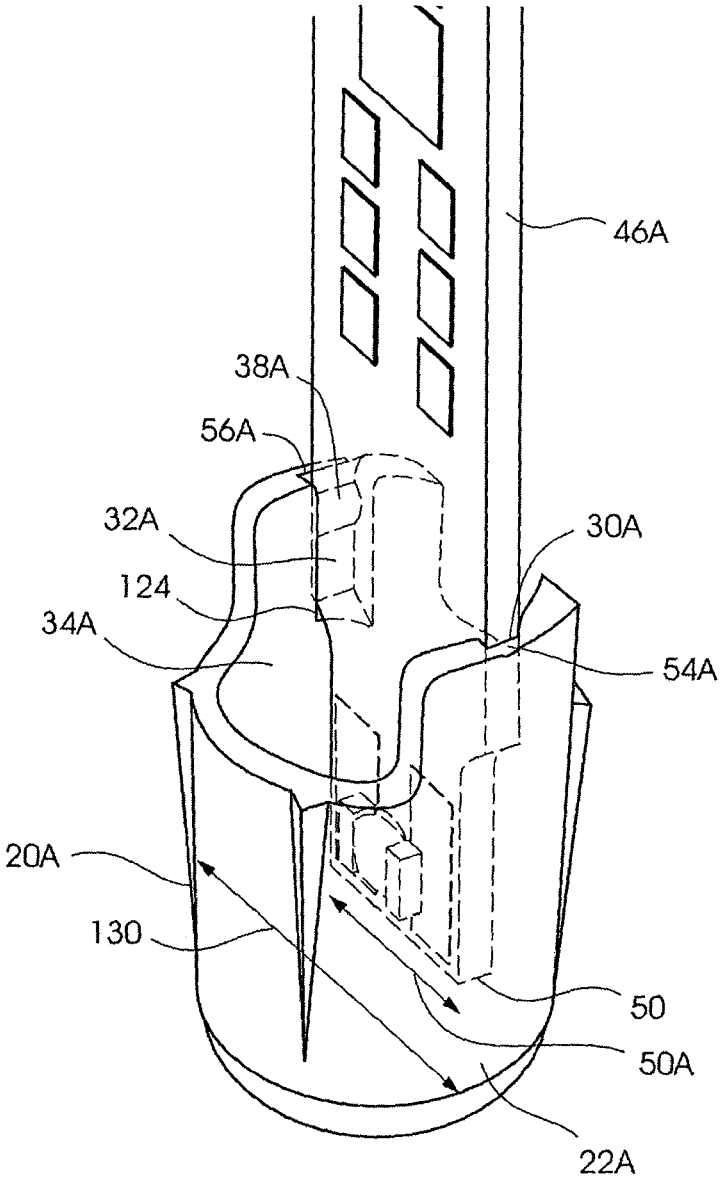
FIG. 11 depicts the container of FIG. 10 in use.

To avoid this possibility the technique shown in FIGS. 10 and 11 can be adopted.

FIG. 10 shows a container 10A with a cup-shaped body 20A. Opposing projections 120 and 122 which extend from the mouth 34A have respective slots 30A and 32A which terminate in stop formations or shoulders 124. Each slot has in its base a small rounded projection 38A.

FIG. 11 shows a printed circuit board 46A with opposed recesses 54A and 56A in sides of the board near a leading end 50. Only one recess 56A is clearly visible in FIG. 11. The leading end has a width 50A which is smaller than an internal diameter 130 of the cup-shaped body 20A.

When the components are to be assembled the body is orientated vertically i.e. with its mouth 34A uppermost. A fluent explosive composition (not shown) is then dispensed into the body. An upper level of the composition is at, or slightly below, the mouth 34A. The composition is thus kept away from the slots 30A and 32A.

The leading end 50 of the printed circuit board is advanced into the body 20A until it strikes the shoulders 124 and, at this time, the recesses 54A and 56A slip into engagement with the respective projections 38A. The printed circuit board 46A is then fixed to the container with the ignition element correctly located and embedded within the fluent composition. This is achieved without the danger that frictional effects, produced by the relative movement of the printed circuit board and the container, could cause ignition of the explosive composition.

The composition is then allowed to set, a process which can advantageously be hastened, through the use of a drying oven, to help drive moisture from the composition.

Figure 12:
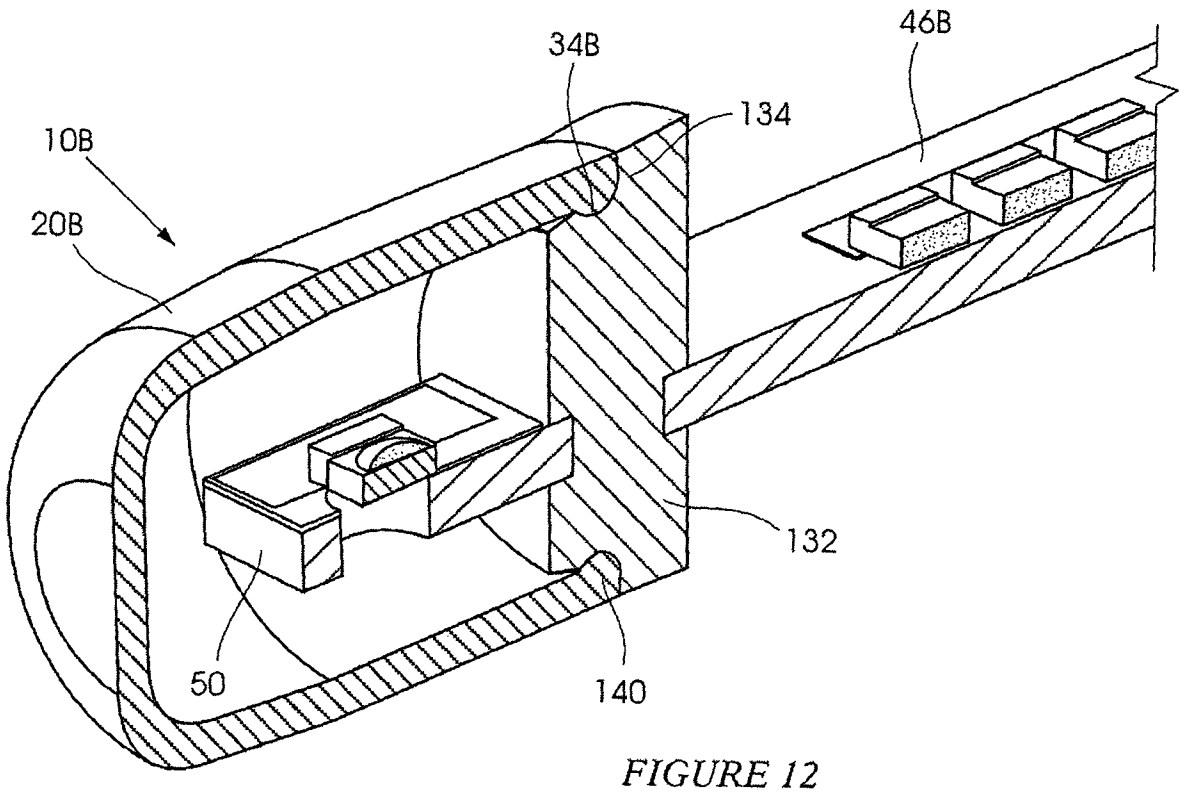
FIG. 12 shows in perspective and in cross-section a different form of the detonator assembly of the invention.

FIG. 12 shows a different approach to the problem. A printed circuit board 46B carries a flexible seal 132 with a shaped rim 134. A leading end 50 of the board can fit, without interference, into a cup-shaped body 20B, of a container 10B, which does not include guide slots or other formations. Frictional effects, of the kind referred to, thus cannot arise. However when the board is correctly positioned the rim 134 of the seal is carefully engaged with a shaped perimeter 140 of a mouth 34B of the body, to retain the components correctly engaged with each other.

Figure 13:
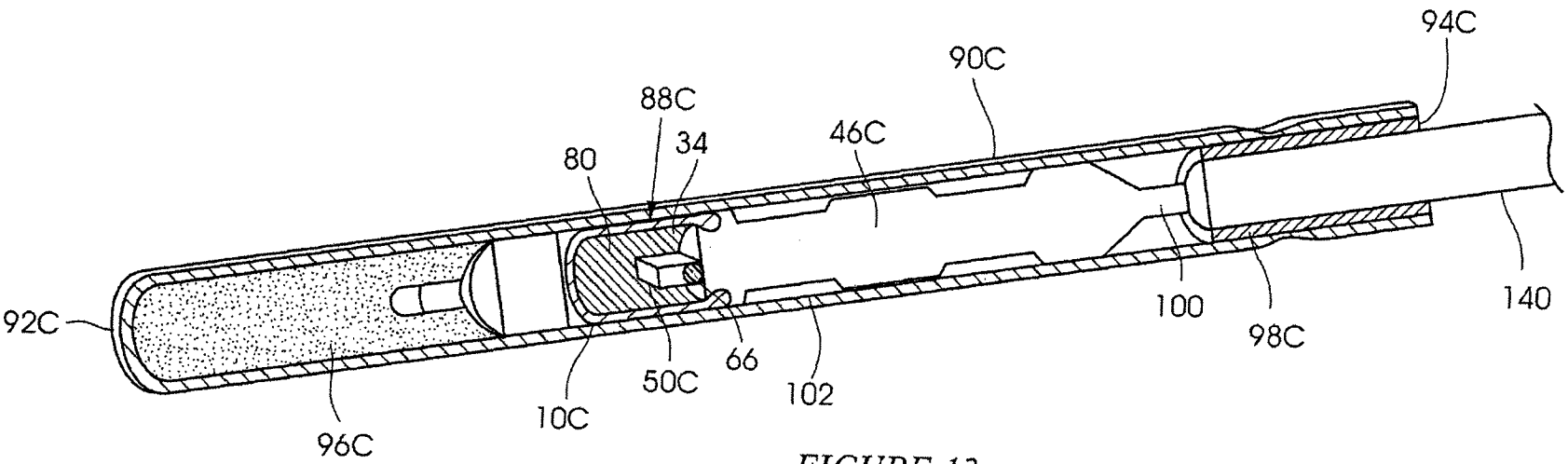
FIG. 13 shows in perspective and in cross-section another form of a detonator assembly of the invention.

FIG. 13 shows a detonator made in accordance with the principles of the aforementioned description but which has a different configuration to what is shown. In this Figure, like reference numerals to those previously used are employed to designate like components.

Prior to assembly of the detonator a fluent explosive composition 80 is placed into an interior of a cup-shaped body 10C. An end 50C of a printed circuit board 46C is immersed in the fluent composition which is then allowed to set to form a detonator assembly 88C which comprises the printed circuit board 46C, the body 10C and the explosive composition 80.

The assembly 88C is then positioned inside a tubular metallic housing 90C which has a blind end 92C and an open end 94C. An explosive material 96C fills part of an interior of the housing between the end 92C and the body 10C. The end 94C is sealed by means of a crimped plug 98C. A harness connection 140, made to components on the printed circuit board, extends through the plug 98C.

The invention claimed is:

1. A detonator which includes a detonator assembly comprising a container which comprises a cup-shaped moulded body with a base, a mouth and a wall with an inner surface and an outer surface, a printed circuit board with a mounting location, an ignition element which is mounted to the board at the mounting location, wherein the ignition element and at least said mounting location extend through the mouth into an interior of the cup-shaped body, the printed circuit board and the cup-shaped body including complementary formations which are interengageable thereby to retain the printed circuit board engaged with the cup-shaped body when the printed circuit board is in a desired position relative to the cup-shaped body, and an explosive composition which, in fluent form, in the interior of the cup-shaped body covers at least the ignition element and the mounting location, and is configured to form a solid component in which the ignition element and the mounting location are embedded.

2. The detonator according to claim 1 wherein the body, on the inner surface, includes keying formations which help to bond the composition, when it sets, to the body.

3. The detonator according to claim 1 wherein the container has at least one guide formation to position the printed circuit board, and thus the ignition element, correctly within the body.

4. The detonator according to claim 1 wherein the container includes at least one formation which is engageable with the printed circuit board thereby to position the ignition element at a desired location within the cup-shaped body.

5. The detonator according to claim 1 further comprising a seal which is engaged with the printed circuit board and which is movable to engage with the mouth of the cup-shaped body when the ignition element is correctly positioned within the body.

6. The detonator according to claim 1 further comprising an elongate tubular housing within which the detonator assembly is located.

7. The detonator according to claim 6 wherein the cup-shaped body has at least one formation to ensure that the detonator assembly is correctly positioned inside the tubular housing and to prevent relative movement between the detonator assembly and the tubular housing.

8. The detonator according to claim 6 further comprising at least one support which is engaged with the printed circuit board and which positions the printed circuit board correctly inside the tubular housing.

9. The detonator according to claim 1 wherein the explosive composition includes at least one of the following: lead azide, lead styphnate, DDNP, DC20, calcium nitriminotetrazole and B/$KNO_3$/DLA, and a binder which is selected from nitro cellulose, gum arabic or Alcolex 290-EVA and which is carried in a solvent which can be volatilized at a temperature of 60° C. to 80° C.

10. A detonator which includes a detonator assembly comprising a printed circuit board with a mounting location, an ignition element which is mounted to the board at the mounting location, a container which comprises a cup-shaped body with a mouth and a wall with an inner surface and an outer surface, and an explosive composition which is placed, in fluent form, into the cup-shaped body to cover at least the ignition element and the mounting location and is configured to form a solid component in which the ignition element and the mounting location are embedded, and wherein the printed circuit board and the cup-shaped body include complementary formations which are interengageable thereby to retain the printed circuit board engaged with the cup-shaped body when the printed circuit board is in a desired position relative to the cup-shaped body.

11. A detonator according to claim 10 wherein the body, on the inner surface, includes keying formations which help to bond the composition, when it sets, to the body.

12. A detonator according to claim 10 wherein the container has at least one guide formation to position the printed circuit board, and thus the ignition element, correctly within the body.

13. A detonator according to claim 10 wherein the container includes at least one formation which is engageable with the printed circuit board thereby to position the ignition element at a desired location within the cup-shaped body.

14. A detonator according to claim 10 which includes a seal which is engaged with the printed circuit board and which is movable to engage with the mouth of the cup-shaped body when the ignition element is correctly positioned within the body.

15. A detonator according to claim 10 which includes an elongate tubular housing within which the detonator assembly is located.

16. A detonator according to claim 15 wherein the cup-shaped body has at least one formation to ensure that the detonator assembly is correctly positioned inside the tubular housing and to prevent relative movement between the detonator assembly and the tubular housing.

17. A detonator according to claim 15 which includes at least one support which is engaged with the printed circuit board and which positions the printed circuit board correctly inside the tubular housing.

18. A detonator according to claim 10 wherein the explosive composition includes at least one of the following: lead azide, lead styphnate, DDNP, DC20, calcium nitriminotetrazole and B/$KNO_3$/DLA, and a binder which is selected from nitro cellulose, gum arabic or Alcolex 290-EVA and which is carried in a solvent which can be volatilized at a temperature of 60° C. to 80° C.

* * * * *